US006138370A

United States Patent [19]

Rolfe

[11] Patent Number: 6,138,370

[45] Date of Patent: Oct. 31, 2000

[54] CHALK LINE HELPER

[76] Inventor: Bruce Rolfe, 387 Bunker Hill Rd., Auburn, N.H. 03032

[21] Appl. No.: 09/081,347

[22] Filed: May 19, 1998

[51] Int. Cl.[7] ..... B44D 3/38

[52] U.S. Cl. ..... 33/407; 33/414

[58] Field of Search ..... 33/347, 370, 371, 33/407, 414, 756, 757, 758, 770; 411/458, 459, 460, 461, 462, 463, 464, 465

[56] References Cited

U.S. PATENT DOCUMENTS

| | | | |
|---|---|---|---|
| Re. 14,947 | 9/1920 | Ballou | 33/758 |
| 74,352 | 2/1868 | Hart et al. | 411/458 |
| 558,113 | 4/1896 | Rodick | 33/758 |
| 605,978 | 6/1898 | Shepherd | 411/459 |
| 1,297,584 | 3/1919 | Mock | 411/458 |
| 1,373,884 | 4/1921 | Gregory | 33/414 |
| 4,926,562 | 5/1990 | Hwu | 33/414 |

*Primary Examiner*—G. Bradley Bennett
*Attorney, Agent, or Firm*—Sheehan Phinney Bass + Green; Brian J. Colandreo

[57] ABSTRACT

A chalk line helper having a generally planar top section, a generally planar bottom section, the bottom section having a plurality of bottom projections positioned perpendicular to the bottom section, a front leading edge, a rear following edge, a first side section having a first wing-shaped projection, the first wing-shaped projection generally slanted toward the rear following edge and inward toward the top section, and a second side section having a second wing-shaped projection, the second-wing shaped projection generally slanted toward the rear following edge and inward toward the top section.

21 Claims, 2 Drawing Sheets

CHALK LINE HELPER

FIELD OF THE INVENTION

The present invention relates generally to the field of carpentry and related construction trades tools, and more particularly to an apparatus and method to enable a carpenter or similar person working alone to lay out and strike chalk lines quickly and accurately.

BACKGROUND OF THE INVENTION

As is well known in the building construction industry, it is often necessary to strike numerous chalk marks to provide precise guide lines for the installation of partition plates, intersection lines of modular flooring and similar applications. Since the distances normally involved are greater than the span of a single worker's arms, it is usually necessary to employ an assistant or to utilize a makeshift means of temporarily holding one end of a chalk line, such as a nail. Such expedients are either time consuming, inconvenient and likely to be inaccurate, and, when utilizing an assistant, costly.

One attempt at creating a time-saving device when using a chalk line marking device is described in U.S. Pat. No. 3,622,471, 1971 (hereinafter Lynde et al) Lynde et al provides a means of holding one end of a tape or chalk line by means of a device . With such an arrangement, the device is held in place frictionally, which gives poor assurance that the device once placed remains undisturbed and where desired. To counter this problem, Lynde et al must be made heavy and thus bulky to provide enough friction to hold the device in place. Moreover, Lynde et al guides a chalk line under the middle of the device through a channel, enabling the snapping of but a single chalk line at a time.

What is needed is an inexpensive, secure, lightweight, convenient and compact device which will enable but a single worker to layout and snap multiple chalk lines accurately and quickly.

SUMMARY OF THE INVENTION

In accordance with the principles of the present invention a chalk line helper is provided including a generally planar top section, a generally planar bottom section, the bottom section having a plurality of bottom projections positioned perpendicular to the bottom section, a front leading edge, a rear following edge, a first side section having a first wing-shaped projection, the first wing-shaped projection generally slanted toward the rear following edge and inward toward the top section, and a second side section having a second wing-shaped projection, the second-wing shaped projection generally slanted toward the rear following edge and inward toward the top section.

One object of the present invention is to provide a tool which is able to be easily and firmly set and held in place, yet is readily and easily removable, of a dimension that is equal to relevant dimensions of standard construction materials, and with which a single worker may quickly and accurately hold one end of a chalk line to permit such worker to snap a chalk line.

Another object of the present invention is to enable a single worker to accurately measure and snap multiple chalk lines separated by a uniform width, such as standard lumber sizes.

Yet another object of the present invention is to enable a single worker to measure accurately and lay out locations of structural elements which are separated by the width of standard construction elements, such as standard lumber sizes.

Still another object of the present invention is to provide a tool of the above nature that is compact, light, durable, dependable and economical.

BRIEF DESCRIPTION OF THE DRAWINGS

The novel features believed characteristic of the invention are set forth in the appended claims. The invention itself, however, as well as features and advantages thereof, will be best understood by reference to the detailed description of specific embodiments which follows, when read in conjunction with the accompanying drawings, wherein:

DETAILED DESCRIPTION OF THE PREFERRED EMBODIMENT

Figure 1:
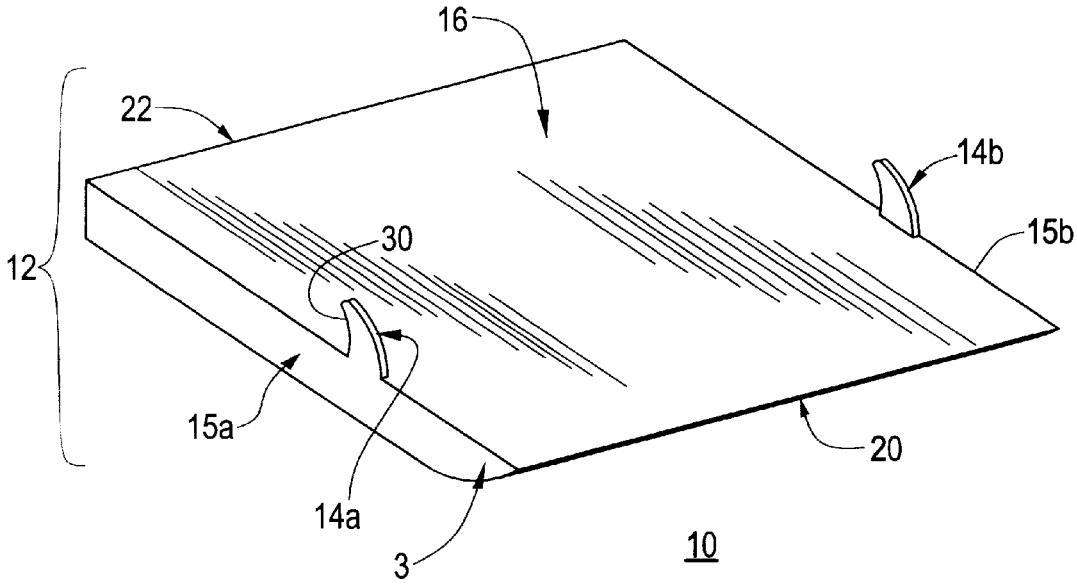
FIG. 1 is an oblique view of a chalk line helper as seen from above and in front.
Figure 2:
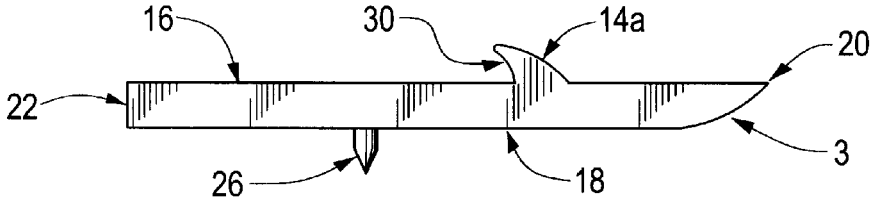
FIG. 2 is a side view of the chalk line helper.

Referring to FIGS. 1 and 2, an exemplary chalk line helper 10 is shown to include a generally rectangular main body 12. The main body 12 further includes a pair of generally triangular hooks or protrusions labeled 14*a* and 14*b* respectively, extending from a top surface 16. The main body 12 also includes a bottom surface 18, a leading edge 20, and a trailing edge 22. Extending from a bottom surface 18 are two or more points 26. It is preferred that the main body 12 include at least two points 26, but more may be included as desired and considering the size of the main body 12. It is preferred that the main body 12 be fabricated from a metallic material, such as steel, and ¼ inch or greater in thickness, which helps to keep a taught chalk line above the surface to be marked, which may be wet, until ready to snap the line.

In the preferred embodiment, two or more pointed and sharpened round points 26 extend from the bottom surface 18. In one embodiment, the points are $\frac{1}{8}^{th}$ inch in diameter and ¼ inch in length. The points should be of a size and length so as to be driven easily into wood or other porous material to secure the helper 10, yet small and short enough to be removed readily by inserting a claw of a hammer under a leading edge 20 of the main body 12. The points 26 may be angled slightly toward the leading edge 20 so as to help hold the helper in place. Other lengths and number of such protrusions may be used as desired.

In the preferred embodiment, the helper includes two hooks 14*a* and 14*b* extending from the top surface 16 and along and coplanar with each side of the main body 12. The hooks 14*a* and 14*b* located generally nearer the leading edge 20 of each side 15*a* and 15*b*, and with an edge nearest the back of the helper forming a hook 30 at an acute angle measured from the back of the main body 12, by means of which hook a chalk line may be attached or looped and extended in the direction of the front of the main body 12.

Figure 3:
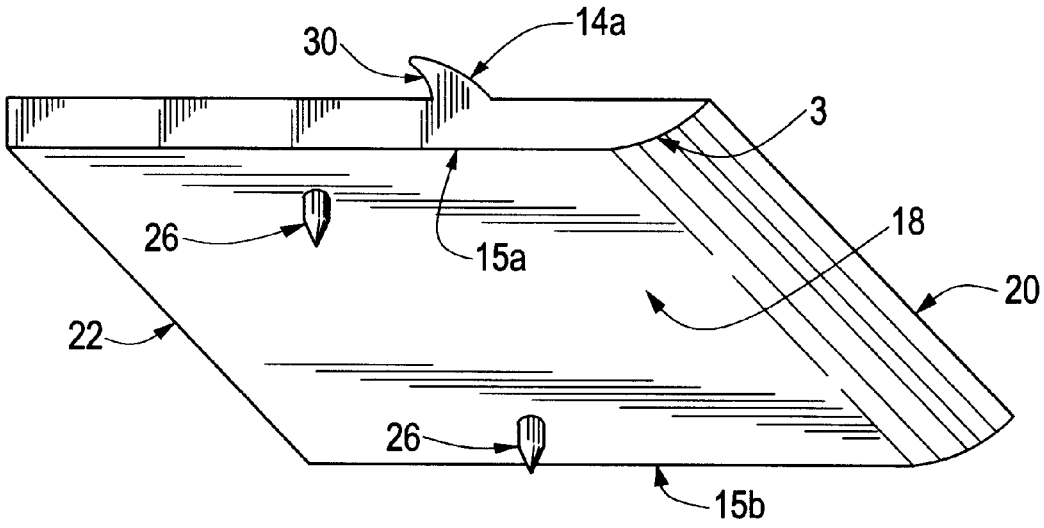
FIG. 3 is an oblique view as seen from the bottom and the front of the chalk line helper.
Figure 4:
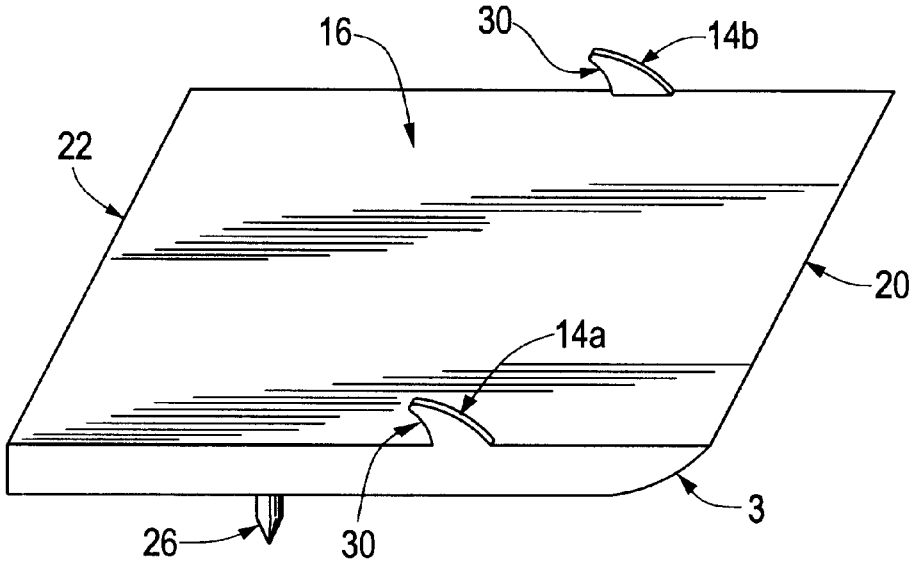
FIG. 4 is an oblique view as seen from above and to one side if the chalk line helper, showing the attachment of a single chalk line.

Referring to FIGS. 3 and 4, the hooks 14*a* and 14*b* are each beveled along the interior surface of each hook so as to form a sharp edge such that when a chalk line 40 is run along the interior side of the hook from the front, looped around the hook and run toward the front, it dresses flushly to an edge 15*a* and 15*b* of the helper. In the preferred embodiment, the underside 18 of the leading edge 20 is beveled 3 so as to provide a means by which a claw end of a hammer (not shown) may be inserted thereunder and used to remove the helper 10 easily.

The helper 12 typically has a width and length which is equal to the longitudinal cross sectional dimensions of a piece of standard structural lumber. In one embodiment of the invention, for example, the length and width of the helper 10 is equivalent to the cross sectional dimensions of a standard two by four. Other embodiments may be sized to correspond with other standard structural elements.

By way of example, the layout of an interior two by four stud wall may be considered. One edge of the wall is located along an outside wall. The helper is placed so that one edge 42*a* is located at the measured location with the trailing edge 22 of the helper 10 perpendicular to the line to be snapped. Once placed, the helper 10 is hammered into place into an underlying porous surface, such as wood, securely held in place by the points 26 being driven into a surface onto which the chalk line is to be snapped.

It will be seen that the outer sides of each of the two hooks 14*a* and 14*b* is separated by exactly the width of the structural element to be installed, in the instant case a two by four. A chalk line (not shown) is attached to the helper 10 by means of one of the hooks 14*b*, run along the interior of the hook 14*b* toward the trailing edge 22 of the helper 10, and then looped around a hook 14*a* along the outer edge 42*a* and drawn out toward the leading edge 20 of the helper 10 to a measured location of the other end of the interior wall and the line is snapped.

It may be seen that if both sides of the interior wall are to be marked by a chalk line, it is a simple task to employ a second instance of a helper 10 at the other end of the interior wall, and simply run the chalk line from a first helper to a second helper, around one hook 14*b* to a second hook 14*a* of a second helper, and back to the second hook 14*b* of the first helper, forming a rectangle. Each line may then be quickly and easily marked. The helper 10 may also be placed on a vertical member for striking vertical chalk lines.

The helper 10 in place may be used as a point of reference for additional measurements, as the helper 10, being the same size as a structural element, forms at each edge a point of reference for the location of a structural element. A tape measure may be placed against one of the edges 15*a* and 15*b* or hooked onto one of the hooks 14*a* and 14*b* to assist the taking of the measurement.

Having described a preferred embodiment of the invention, it will now become apparent to those skilled in the art that other embodiments incorporating its concepts may be provided. It is felt therefore, that this invention should not be limited to the disclosed invention, but should be limited only by the spirit and scope of the appended claims.

What is claimed is:

1. A chalk line helper comprising:

a generally planar top section;

a generally planar bottom section, the bottom section having a plurality of bottom projections positioned perpendicular to the bottom section;

a front leading edge;

a rear following edge;

a first side section having a first wing-shaped projection for receiving a chalk line, the first wing-shaped projection generally slanted toward the rear following edge and inward toward the top section; and a second side section having a second wing-shaped projection for receiving a chalk line, the second-wing shaped projection generally slanted toward the rear following edge and inward toward the top section.

2. The chalk line helper according to claim 1 wherein the plurality of bottom projections comprises:

a first projection, the first projection having a first projection point to enable penetration into a porous material;

a second projection, the second projection having a second projection point to enable penetration into the porous material.

3. The chalk line helper according to claim 1 wherein the plurality of bottom projections comprises:

a first projection, the first projection having a first projection point to enable penetration into a porous material;

a second projection, the second projection having a second projection point to enable penetration into the porous material; and the first projection and the second projection spaced evenly apart on the bottom section at a equal length from the rear following edge.

4. The chalk line helper according to claim 1 wherein the front leading edge is tapered back from the top section to the bottom section.

5. The chalk line helper according to claim 1 wherein the first wing-shaped projection further comprises:

a leading contour having an angle of greater than ninety degrees (90°) from the front leading edge; and a trailing contour having an angle of less than ninety degrees (90°) from the rear following edge.

6. The chalk line helper according to claim 1 wherein the second wing-shaped projection further comprises:

a leading contour having an angle of greater than ninety degrees (90°) from the front leading edge; and a trailing contour having an angle of less than ninety degrees (90°) from the rear following edge.

7. The chalk line helper according to claim 1 wherein the front leading edge and the rear following edge have a length adapted to the width of a two by four (2×4) piece of lumber.

8. The chalk line helper according to claim 1 wherein the front leading edge and the rear following edge have a length adapted to the width of a two by six (2×6) piece of lumber.

9. A chalk line helper comprising:

a generally rectangular body, the body having a flat undersurface from which extend a plurality of protrusions; and a top of the body on each side and coplanar with each side are means for hookingly interengaging a chalk line.

10. The chalk line helper according to claim 9 wherein an underside of a front edge is beveled.

11. The chalk line helper according to claim 9 wherein the length and width of the body is equal to the cross sectional dimensions of a piece of standard piece of structural lumber.

12. The chalk line helper according to claim 11 in which the length and width of the tool is equal to the cross sectional dimensions of two by four.

13. The chalk line helper according to claim 11 in which the length and width of the tool is equal to the cross sectional dimensions of two by six.

14. The chalk line helper as described in claim 9 wherein the means for hookingly interengaging the chalk line comprises:

two generally triangular extrusions, one surface of each of which is parallel to and coplanar with each side of the helper, and the rearmost edge of which forms an acute angle from the back edge to the top of the rearmost edge, thus forming a hook.

15. The chalk line helper according to claim 14 wherein the rearmost edge of the hook is beveled on the inside surface.

16. The chalk line helper according to claim 9 in which the plurality of protrusions are angled away from the front leading edge.

17. The chalk line helper according to claim 9 in which the thickness of the main body is between ¼ and ½ inch.

18. A chalk line helper comprising:

a generally planar top section;

a front leading edge;

a rear following edge;

a generally planar bottom section, the bottom section having a plurality of bottom projections angled towards the front leading edge;

a first side section having a first wing-shaped projection for receiving a chalk line, the first wing-shaped projection generally slanted toward the rear following edge and inward toward the top section; and a second side section having a second wing-shaped projection for receiving a chalk line, the second-wing shaped projection generally slanted toward the rear following edge and inward toward the top section.

19. A chalk line helper comprising:

a generally planar body having a top surface, a bottom surface, a front edge, a back edge, a left edge, and a right edge;

a first upwardly extending extrusion, located on said top surface and positioned proximate said front edge and said left edge of said planar body, for receiving a chalk line;

a second upwardly extending extrusion, located on said top surface and positioned proximate said front edge and said right edge of said planar body, for receiving a chalk line; and a plurality of downward extending extrusions, located on said bottom surface of said planar body, for releasably engaging the object or surface to which said chalk line helper is attached;

wherein said first and second upwardly extending extrusions are spaced apart a distance equal to the width of a piece of structural lumber.

20. The chalk line helper of claim 19 wherein said front edge of said planar body is beveled to allow for easy removal of said chalk line helper from the surface to which it is attached.

21. The chalk line helper of claim 19 wherein said back edge of said planar body is beveled to allow for easy removal of said chalk line helper from the surface to which it is attached.

* * * * *